US007667403B2

(12) United States Patent
Kwon et al.

(10) Patent No.: US 7,667,403 B2
(45) Date of Patent: Feb. 23, 2010

(54) PLASMA DISPLAY PANEL INCLUDING A COLOR FILTER LAYER

(75) Inventors: Jae-Ik Kwon, Suwon-si (KR); Won-Ju Yi, Suwon-si (KR); Ho-Young Ahn, Suwon-si (KR); Kyoung-Doo Kang, Suwon-si (KR); Dong-Young Lee, Suwon-si (KR); Soo-Ho Park, Suwon-si (KR); Seok-Gyun Woo, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 364 days.

(21) Appl. No.: 11/703,650

(22) Filed: Feb. 8, 2007

(65) Prior Publication Data

US 2007/0188098 A1 Aug. 16, 2007

(30) Foreign Application Priority Data

Feb. 10, 2006 (KR) ..... 10-2006-0012902

(51) Int. Cl.
*H01J 17/49* (2006.01)

(52) U.S. Cl. ..... 313/582; 313/584

(58) Field of Classification Search ..... 313/582–587
See application file for complete search history.

(56) References Cited

U.S. PATENT DOCUMENTS 5,744,909 A * 4/1998 Amano ..... 313/585
5,962,975 A 10/1999 Lepselter
7,471,044 B2 12/2008 Woo et al.
7,508,135 B2 3/2009 Kang et al.
7,518,310 B2 4/2009 Yoo et al.
2004/0245926 A1 12/2004 Bechtel et al.
2005/0099122 A1 5/2005 Wan et al.
2005/0225241 A1* 10/2005 Woo et al. ..... 313/582
2005/0236988 A1 10/2005 Kwon
2006/0001608 A1 1/2006 Kang et al.
2006/0186778 A1 8/2006 Yoo et al.
2006/0226780 A1 10/2006 Kwon et al.

FOREIGN PATENT DOCUMENTS

CN 1 622 264 A 6/2005
CN 1 681 069 A 10/2005

(Continued)

OTHER PUBLICATIONS

English Translation of KR 10-2005-0112580.*

(Continued)

*Primary Examiner*—Nimeshkumar D. Patel
*Assistant Examiner*—Mary Ellen Bowman
(74) *Attorney, Agent, or Firm*—Lee & Morse, P.C.

(57) ABSTRACT

A plasma display panel may include a first substrate and a second substrate facing each other, barrier ribs disposed between the first substrate and the second substrate, and at least partially defining a plurality of discharge cells therebetween, a plurality of pairs of discharge electrodes for generating a discharge in the discharge cells, the plurality of pairs of discharge electrodes being arranged in non-display portions of the plasma display panel, and a color filter layer disposed between the barrier ribs and the first substrate.

21 Claims, 5 Drawing Sheets

FOREIGN PATENT DOCUMENTS

| | | | |
|---|---|---|---|
| JP | 01-194240 | A | 8/1989 |
| JP | 10-214569 | A | 8/1998 |
| JP | 10-282330 | A | 10/1998 |
| JP | 2005-166654 | A | 6/2005 |
| JP | 2005-310786 | A | 11/2005 |
| JP | 2006-018259 | A | 1/2006 |
| KR | 10-2000-0066874 | | 11/2000 |
| KR | 2000-0066874 | A | 11/2000 |
| KR | 10-2005-0112580 | | 12/2005 |
| WO | WO 02/097848 | A2 | 12/2002 |

OTHER PUBLICATIONS

English Translation of KR2000-0066874.*

* cited by examiner

PLASMA DISPLAY PANEL INCLUDING A COLOR FILTER LAYER

BACKGROUND OF THE INVENTION

1. Field of the Invention

The present invention relates to a plasma display panel. More particularly, the invention relates to a plasma display panel that can be easily manufactured.

2. Description of the Related Art

Plasma display panels (PDP) are flat display panels that display images using a gas discharge phenomena, and are considered to be the next generation of flat display panels due to good display properties, e.g., thinness, display capacity, brightness, contrast, afterimage, and viewing angle.

PDP manufacturing processes employ separate processes for manufacturing different colored, i.e., red, green, and blue, discharge cells, Thus, the manufacturing process of PDPs may be complicated and may have high production costs.

SUMMARY OF THE INVENTION

The present invention is therefore directed to plasma display panel, which substantially overcomes one or more of the problems due to the limitations and disadvantages of the related art It is therefore a feature of an embodiment of the present invention to provide a plasma display panel that can be manufactured more easily relative to PDPs manufactured using at least two separate processes forming discharge cells associated with two or more different colors.

At least one of the above and other features and advantages of the present invention may be realized by providing a plasma display panel including a first substrate and a second substrate facing each other, barrier ribs disposed between the first substrate and the second substrate, and at least partially defining a plurality of discharge cells therebetween, a plurality of pairs of discharge electrodes for generating a discharge in the discharge cells, the plurality of pairs of discharge electrodes being arranged in non-display portions of the plasma display panel, and a color filter layer disposed between the barrier ribs and the first substrate.

The color filter layer may include a pattern of red color filter layers, green color filter layers and blue color filter layers formed corresponding to the discharge cells. The color filter layer further may include light absorbing layers formed corresponding to the barrier ribs. The light absorbing layers may be substantially opaque. Each of the red color filter layers, green color filter layers and blue color filter layers may be separated by a light absorbing layer, and corresponds to a single one of the plurality of discharge cells.

Each of the pairs discharge electrodes may include a first discharge electrode and a second discharge electrode substantially spaced apart from each other along a direction perpendicular to a direction along which the first substrate extends, the first discharge electrode and the second discharge electrode may extend in directions crossing each other, and the first discharge electrode and the second discharge electrode may surround at least some portions of each discharge cell disposed along the respective directions in which each of the first discharge electrode and the second discharge electrode extend.

Each of the pairs of discharge electrodes may include a first discharge electrode and a second discharge electrode arranged within the barrier ribs and substantially spaced apart from each other in a vertical direction to the first substrate, the first discharge electrode and the second discharge electrode may extend parallel to each other, and the first discharge electrode and the second discharge electrode may surround at least some portions of each discharge cell disposed along the respective directions in which each of the first discharge electrode and the second discharge electrode extend.

The plasma display panel may include address electrodes at least partially disposed in the barrier ribs and spaced apart from the plurality of pairs of discharge electrodes along a direction perpendicular to a direction along which the first substrate extends, the address electrodes may substantially extend in a direction crossing the plurality of pairs of discharge electrodes, wherein the address electrodes may surround at least some portions of each discharge cell disposed in the respective directions along which each of the address electrodes extend.

The plasma display panel may include phosphor layers formed in the discharge cells. The phosphor layers may include a white light emitting phosphor substance.

The barrier ribs may include first barrier ribs and second barrier ribs, the plurality of pairs of discharge electrodes may at least partially extend within the first barrier ribs, and the second barrier ribs at least partially overlap the first barrier ribs such that respective overlapping portions of the first and second barrier ribs extend between the first substrate and the second substrate, and at least some portions of the phosphor layers may be formed on the second barrier ribs.

The first barrier ribs and the second barrier ribs may have at least one of a different cross-sectional shape along a plane substantially parallel to the first substrate and a different size. The first barrier ribs may have a cross-sectional shape along a plane substantially parallel to the first substrate such that the barrier ribs define a plurality of cylindrical shaped portions between the first substrate and the second substrate.

Each of the plurality of pairs of discharge electrodes may include a plurality of circular shaped portions at least partially surrounding respective ones of the plurality of cylindrical shaped portions defined by the barrier ribs. Each of the plurality of circular shaped portions corresponding to each of the discharge electrodes may be electrically connected. The discharge cells may have a polygonal cross sectional shape along a plane substantially parallel to the first substrate.

The first barrier ribs and the second barrier ribs may have at least one of a same cross-sectional shape along a plane substantially parallel to the first substrate and a same size. The barrier ribs may include a plurality of dielectric layers stacked on each other. Each of the plurality of discharge cells may include a white light emitting phosphor substance.

The color filter layer may be disposed in a groove formed on a surface of the first substrate that faces the second substrate.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
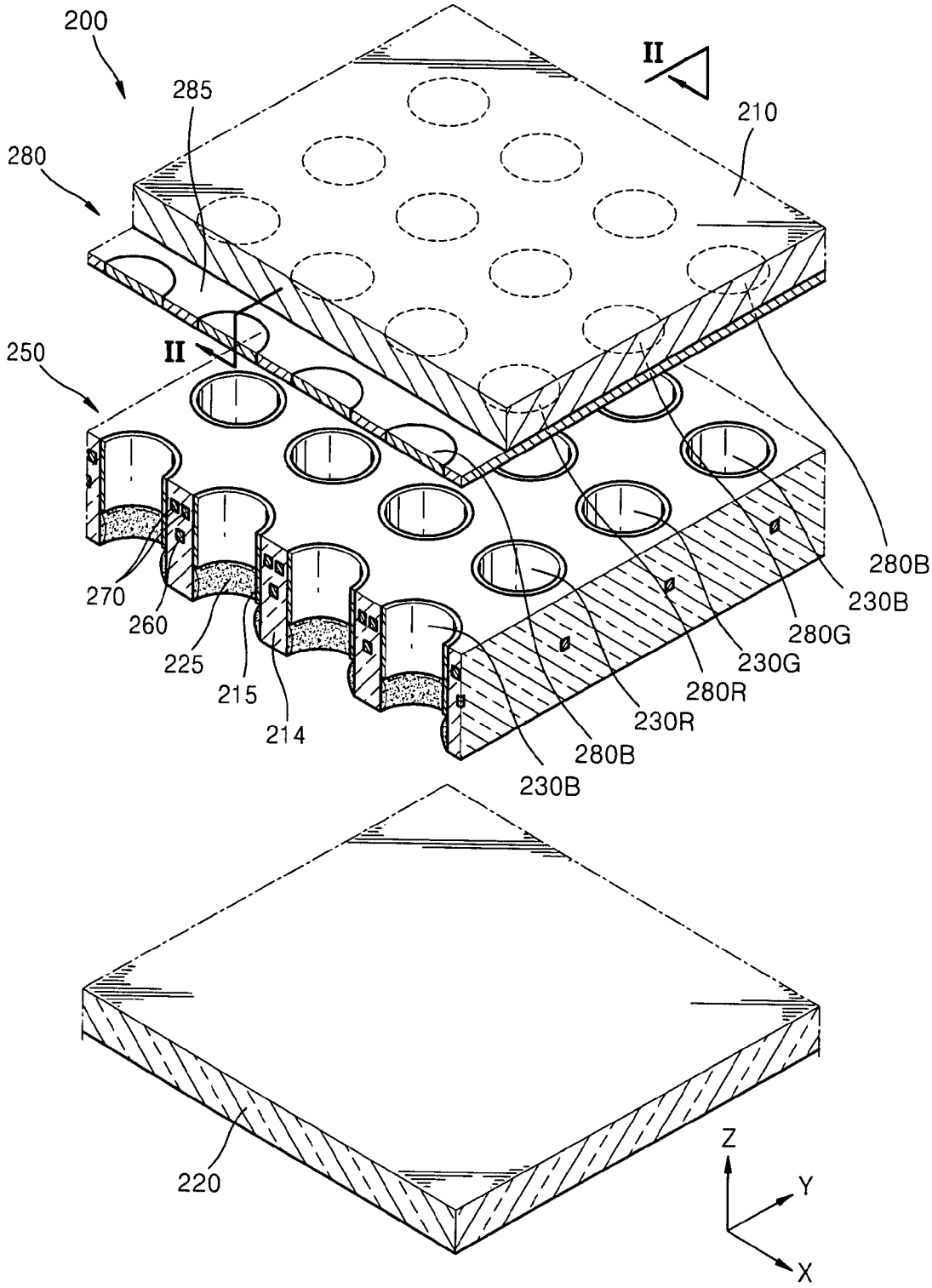
FIG. 1 illustrates a partially exploded perspective view of a plasma display panel according to an exemplary embodiment of the present invention.

Korean Patent Application No. 10-2006-0012902, filed on Feb. 10, 2006, in the Korean Intellectual Property Office, and entitled: "Plasma Display Device," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
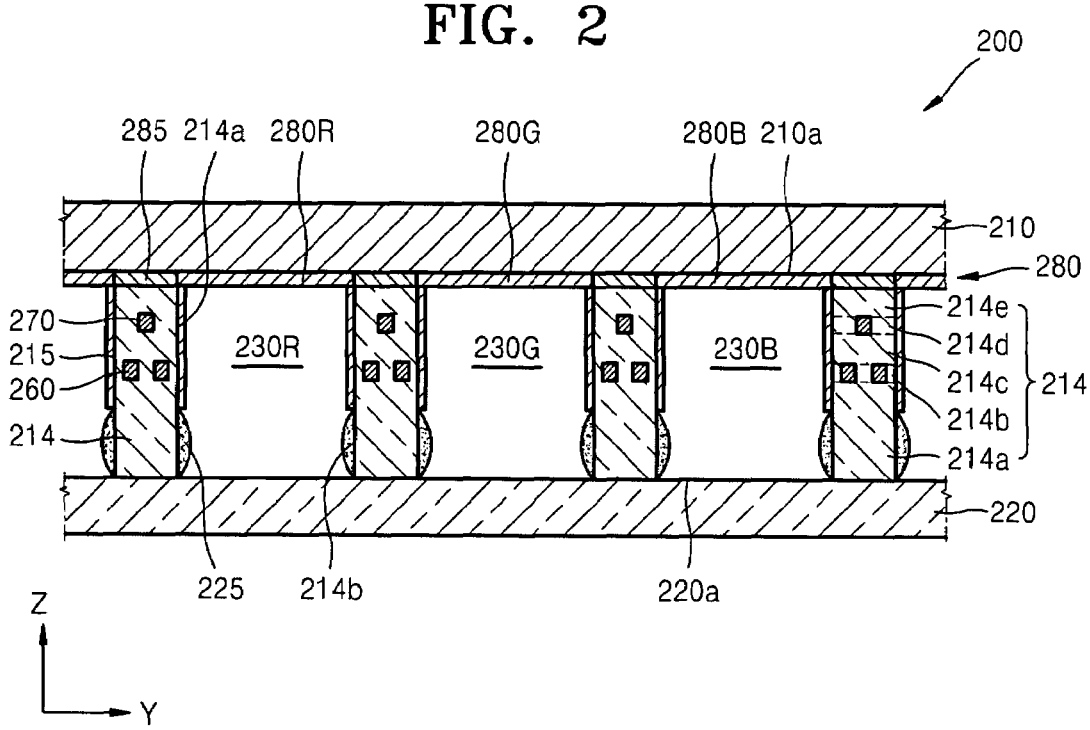
FIG. 2 illustrates a partial cross-sectional view of the exemplary plasma display panel illustrated in FIG. 1, taken along a line II-II of FIG. 1.
Figure 3:
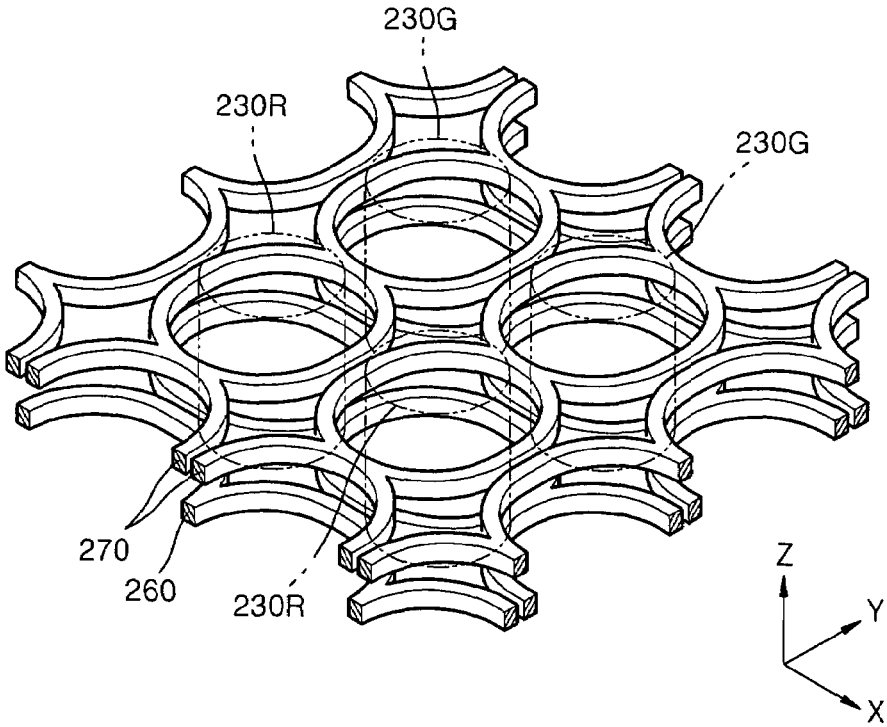
FIG. 3 illustrates a schematic layout diagram of discharge cells and first and second discharge electrodes of the exemplary plasma display panel illustrated in FIG. 1.

FIG. 1 illustrates a partially exploded perspective view of a plasma display panel 200 according to an exemplary embodiment of the present invention. FIG. 2 illustrates a partial cross-sectional view of the exemplary plasma display panel illustrated in FIG. 1, taken along a line II-II of FIG. 1. FIG. 3 illustrates a schematic layout diagram of red discharge cells 230R, green discharge cells 230G and blue discharge cells 230B, and first and second discharge electrodes of the exemplary plasma display panel illustrated in FIG. 1.

Referring to FIG. 1, the plasma display panel 200 may include a first substrate 210 and a second substrate 220 facing each other. The first substrate 210 may be formed of a material having excellent light transmission properties such as glass. In some embodiments of the invention, the first substrate 210 may be colored, e.g., include a colored material, in order to increase the bright room contrast by reducing reflective brightness. The second substrate 220 may be spaced apart from the first substrate 210. The second substrate 220 may be formed of a material having excellent light transmission properties, such as glass, and may be colored, similar to the first substrate 210. The red, green and blue discharge cells 230R, 230G and 230B may be disposed between the first and second substrates 210 and 220. Visible light generated in the red, green and blue discharge cells 230R, 230G and 230B may be transmitted through the first substrate 210.

In conventional plasma display panels, sustain electrodes may be disposed on a first substrate, and thus, may result in a low transmission rate of visible light as some of the visible light may be blocked by the sustain electrodes overlapping the discharge cells, i.e., blocked by portions of the sustain electrodes overlapping the discharge cells along a direction, e.g., Y direction, substantially perpendicular to directions along which first and second substrates extend.

However, referring to FIG. 2, in embodiments of the invention, first and second discharge electrodes 260 and 270 of the plasma display panel 200 may not be disposed on the first substrate 210 and/or may not overlap the discharge cells along the Y direction on a side(s) on which an image(s) is to be displayed. Thus, embodiments of the invention may provide plasma display panels having an improved transmission rate of visible light relative to conventional plasma display panels.

Referring to FIG. 1, an electrode sheet 250 may include barrier ribs 214 at least partially defining the red, green and blue discharge cells 230R, 230G and 230B. Cross-sectional shapes of the red, green and blue discharge cells 230R, 230G and 230B along an XY plane may correspond to cross sectional shapes of the barrier ribs 214 along the respective XY plane. For example, in some embodiments of the present invention, the barrier ribs 214 may be formed such that the red, green and blue discharge cells 230R, 230G and 230B may have circular cross sections, along, e.g., an XY plane. In some other embodiments, e.g., the red, green and blue discharge cells 230R, 230G and 230R may have polygonal cross sections, e.g., triangular cross sections, tetragonal cross sections, pentagonal cross sections, etc., or oval cross sections.

The electrode sheet 250 may include a plurality of pairs of the first discharge electrodes 260 and the second discharge electrodes 270. That is, e.g., the first discharge electrodes 260 and/or the second discharge electrodes 270 may extend at least partially within the electrode sheet 250. More particularly, referring to FIGS. 1 and 2, the first discharge electrode (s) 260 and the second discharge electrode(s) 270 may be at least partially disposed in the barrier ribs 214 of the electrode sheet 250. The pairs of first discharge electrodes 260 and second discharge electrodes 270 may respectively generate discharge in the red, green and blue discharge cells 230R, 230G and 230B.

Referring to FIG. 3, the first discharge electrodes 260 may extend along the X direction. For example, the first discharge electrodes 260 may extend substantially parallel to each other along the X direction, and may surround a plurality of circular portions in a row along an XY plane. More particularly, the first discharge electrodes 260 may surround, along an XY plane, a plurality of, e.g., circular spaced portions in a row along the X direction. In some embodiments of the invention, all the circular shaped portions, along the XY plane, surrounded by each of the first discharge electrodes 260 may correspond to one of the different colors, e.g., red, green or blue. For example, a first one of the first discharge electrodes 260 may surround, along an XY plane, an entire row, along the X direction, of red discharge cells 230R, a second one of the discharge electrodes 260, which may be adjacent to the first one of the first discharge electrodes 260, may surround, along an XY plane, an entire row, along the X direction, of green discharge cells 230G, and a third one of the first discharge electrodes 260, which may be adjacent to the second one of the first discharge electrodes 260, may surround, along an XY plane, an entire row, along the X direction, of blue discharge cells 230B. Adjacent ones of the first discharge electrodes 260 may be spaced apart from each other along the Y direction. Embodiments of the invention are not limited to such an arrangement.

Referring to FIG. 3, the second discharge electrodes 270 may extend along the Y direction, and may to surround, along the XY plane, the red, green and blue discharge cells 230R, 230G and 230B aligned in a row along the Y direction. As illustrated in FIG. 3, the X direction may cross the Y direction, and the Z direction may cross both the X direction and the Y direction. Adjacent ones of the second discharge electrodes 270 may be spaced apart from each other, along the Z direction. The first discharge electrodes 260 and the second discharge electrodes 270 may be formed closer to the first substrate 210, and the first discharge electrodes 260 may be spaced apart from the second discharge electrodes 270 along the Z direction. In embodiments of the invention, the second discharge electrodes 270 may be formed closer to the first substrate 210 than the first discharge electrodes 260. Embodiments of the invention are not limited to such an arrangement.

The exemplary embodiment of the plasma display panel 200 illustrated in FIGS. 1-3 has a two-electrode structure. In such exemplary embodiments, one of the first discharge electrodes 260 and the second discharge electrodes 270 may serve as scan and sustain electrodes, and the other can serve as address and sustain electrodes.

Referring to FIGS. 1 and 2, because the first discharge electrodes 260 and the second discharge electrodes 270 may be disposed so as not to overlap the discharge cells 230R, 230G, 230B along the Z direction, e.g., in the barrier ribs 214, the first and/or second discharge cells 260, 270 may be formed of a conductive metal, e.g., aluminum, copper, etc. Accordingly, when a voltage is applied to the first discharge electrodes 260 and the second discharge electrodes 270, stable signal transmissions are possible due to a relatively small voltage drop of the first and second discharge electrodes 260 and 270.

The barrier ribs 214 may prevent direct conduction between the first discharge electrodes 260 and the second discharge electrodes 270. The barrier ribs 214 may also prevent the first discharge electrodes 260 and the second discharge electrodes 270 from being damaged due to direct collisions of positive ions and electrons with the first and second electrodes 260 and 270. Also, the barrier ribs 214 may accumulate wall charges by inducing charges. Accordingly, the barrier ribs 214 may be formed of dielectric substances. As illustrated in FIG. 1, the barrier ribs 214 may completely or substantially extend along a distance between the first substrate 210 and the second substrate 220. For example, in some embodiments of the invention, the barrier ribs 214 may define completely independent spaces corresponding to the discharge cells 230G, 230B, 230R between the first substrate 210 and the second substrate 220, while in other embodiments of the invention, at least some of the barrier ribs 214 may only partially, i.e., not completely, extend between the first substrate 210 and the second substrate 220.

The electrode sheet 250 may further include protective layers 215 formed on portions of sidewalls of the barrier ribs 214 corresponding to the first and second discharge electrodes 260 and 270. For example, the protective layers 215 may be formed on respective portions, e.g., upper end portions 214*a*, of the barrier ribs 214 overlapping, along the XY directions, a general area where the first and second discharge electrodes 260, 270 may be disposed. The protective layers 215 may prevent damage of the barrier ribs 214 caused by plasma particles. The protective layers 215 may also generate secondary electrons to reduce discharge voltage. The protective layers 215 may be formed by coating magnesium oxide (MgO) on the sidewalls of the barrier ribs 214.

Phosphor layers 225 may be formed on some or all portions 214*b* of the sidewalls of the barrier ribs 214 on which the protective layers 215 are not formed. The phosphor layers 225 may be white light-emitting phosphor layers that generate white light using received ultraviolet light. The phosphor layers 225 may be formed by mixing red, green and blue light-emitting phosphor substances. In embodiments of the invention employing such a mixture of red, green and blue light-emitting phosphor substances, the ratio of the red, green and blue light-emitting phosphor substances may be determined considering various properties, e.g., color temperature and durability, of the plasma display panel 200. The red light-emitting phosphor substances may be $(Y,Gd)BO_3:Eu^{3+}$, the green light-emitting phosphor substances may be $Zn_2SiO_4$:Mn and the blue light-emitting phosphor substances may be $BaMgAl_{14}O_{23}:Eu^{2+}$.

A color filter layer 280 may be formed between the barrier ribs 214 and the first substrate 210. In some embodiments of the invention, the color filter layer 280 may be formed on a bottom surface 210*a* of the first substrate 210. For example, the color filter layer 280 may be formed directly on the bottom surface 210*a* of the first substrate 210. The color filter layer 280 may include a red color filter layer(s) 280R, a green color filter layer(s) 280G, a blue color filter layer(s) 280B and light absorbing layers 285. The red, green and blue color filter layers 280R, 280G and 280B may correspond to the red, green and blue discharge cells 230R, 230G and 230B, respectively. The red color filter layer(s) 280R may transmit red light selected from white light formed by the phosphor layer (s) 225 in the respective red discharge cell(s) 230R, the green color filter layer(s) 280G may transmit green light selected from white light formed by the phosphor layer(s) 225 in the respective green discharge cell(s) 230G, and the blue color filter layer(s) 280B may transmit blue light selected from white light formed by the phosphor layer(s) 225 in the respective blue discharge cell(s) 230B. Accordingly, a desired image(s) may be displayed using red light, green light and/or blue light formed by the red, green and/or blue color filter layers 280R, 280G, 280B, respectively.

The light absorbing layers 285 may be substantially or completely opaque material, e.g., black, and may absorb external light. The light absorbing layers 285 may be formed corresponding to non-discharge areas, e.g., some or all of the portions that do not overlap the discharge cells 230R, 230G, 230B along the Z direction. That is, e.g., the light absorbing layers 285 may overlap some or all portions of the barrier ribs 214 along the Z direction. By providing light absorbing layers 285, embodiments of the invention, may improve bright room contrast of the plasma display panel 200 by reducing external light refection.

A discharge gas such as Ne, Xe, or a mixture thereof may be sealed in the red, green and blue discharge cells 230R, 230G and 230B.

An exemplary embodiment of a method for manufacturing the plasma display panel 200 will be described below. The first substrate 210, the second substrate 220 and the electrode sheet 250 may be prepared. The color filter layer 280 may be formed on the first substrate 210.

The electrode sheet 250 may be manufactured using the following method. Referring to FIG. 2, multiple dielectric sheets 214*a*-214*e* may be sequentially formed and the first and second electrodes 260, 270 may be formed between respective ones of the sequentially formed multiple dielectric sheets 214*a*-214*e*. In embodiments of the invention, at least portions, e.g., barrier ribs 214, of the electrode sheet 250 may substantially or completely extend between the first substrate 210 and the second substrate 220 as a result of, e.g., the multiple dielectric sheets 214*a*-241*e* stacked on each other. More particularly, the first dielectric sheet 214*a* may be formed on an upper surface 220*a* of the second substrate 220, the second dielectric sheet 214*b* including the first discharge electrodes 260 may be then be formed on the first dielectric sheet 214*a*. The third dielectric sheet 214*c* may then be formed on the second dielectric sheet including the first discharge electrodes 260, and the fourth dielectric sheet 214*d* including the second discharge electrodes 270 may be formed on the third dielectric sheet 214. The fifth dielectric sheet 214*e* may then be formed on fourth dielectric sheet 214*d* including the second discharge electrodes 270. The first dielectric sheet 214*a*, the second dielectric sheet 214*b* including the first discharge electrodes 260, the third dielectric sheet 214*c*, the fourth dielectric sheet 214*d* including the second discharge electrodes 270, and the fifth dielectric sheet 214*e* may be laminated in sequence, and then dried and baked. In the exemplary embodiment illustrated in FIG. 2, five dielectric sheets 214*a*-214*e* are illustrated, however, embodiments of the invention are not limited to five dielectric sheets 214*a*-214*e*.

The phosphor layers 225 may then be formed on the red, green and blue discharge cells 230R, 230G and 230B. As illustrated in FIG. 2, in some embodiments of the invention, the phosphor 225 may be formed on, e.g., lower end portions of the barrier ribs 214 close to the upper surface 220*a* of the second substrate 220.

The electrode sheet 250 may be completed by depositing the protective layers 215 on the inner sidewalls of the barrier ribs 214. After the first substrate 210, the second substrate 220 and the electrode sheet 250 are prepared, the first substrate 210 and the second substrate 220 may be sealed using frit glass. The plasma display panel 200 may be completed by performing an impure gas exhausting/discharge gas injection process. As described above, the phosphor layers 225 may be commonly formed on the red, green and blue discharge cells 230R, 230G and 230B, thereby simplifying a process of manufacturing the plasma display panel 200, and reducing manufacturing time. Accordingly, production costs may also be reduced. Embodiments of the invention may thus provide a simplified, less-expensive, and less-time consuming method of manufacturing a plasma display panel relative to conventional methods employing, e.g., a separate process for each primary color generated.

An exemplary method of operating the plasma display panel 200 according to an embodiment of the present invention having the above structure will now be described.

During an addressing period, an address discharge may be generated between the first discharge electrodes 260 and the second discharge electrodes 270, resulting in the selection of respective ones of the red, green and blue discharge cells 230R, 230G and 230B to be turned on during a subsequent sustain discharge period.

Thereafter, during the subsequent sustain discharge period, when a sustain voltage is applied between the first discharge electrodes 260 and the second discharge electrodes 270, sustain discharge may occur in the respective ones of the red, green and blue discharge cells 230R, 230G and 230B that were selected during the previous addressing period. The sustain discharge may be generated between the first and second discharge electrodes 260 and 270. As a result of the sustain discharge, an energy level of the discharge gas excited by the sustain discharge may be reduced, thereby discharging ultraviolet light. The ultraviolet light may in turn excite the phosphor layers 225, such that an energy level of the excited phosphor layers 225 may be reduced to generate white light. The generated white light may be transmitted through the red, green and blue color filter layers 280R, 280G and 280B to become red, green and blue light respectively. One of the red, green and blue lights may independently form an image, or a combination, e.g., mixture, of the red, green and/or blue lights may form an image. In embodiments of the invention, resolution of the plasma display panel may be improved by optimizing the red, green and blue color filter layers 280R, 280G and 280B.

Embodiments of the invention may provide plasma display panels having larger discharge areas relative to conventional plasma display panels in which sustain discharge may be generated perpendicular to a first substrate between sustain electrodes arranged thereon. That is, e.g., the plasma display panel 200 of the present invention may have a relatively large discharge area due to the sustain discharge generated on all sides of the barrier ribs 214. Also, in embodiments of the present invention, the sustain discharge may form a closed curve along sidewalls of the barrier ribs 214 and may gradually extend to a center of each of the red, green and blue discharge cells 230R, 230G and 230B. Accordingly, a size of the sustain discharge area may be larger. Also, in embodiments of the invention, the sustain discharge may be generated mainly at the center of each of the red, green and blue discharge cells 230R, 230G and 230B, which may prevent ion sputtering of the phosphor layers 225. Accordingly, in embodiments of the invention, image sticking may not occur even when the same image is displayed for a long time.

Figure 4:
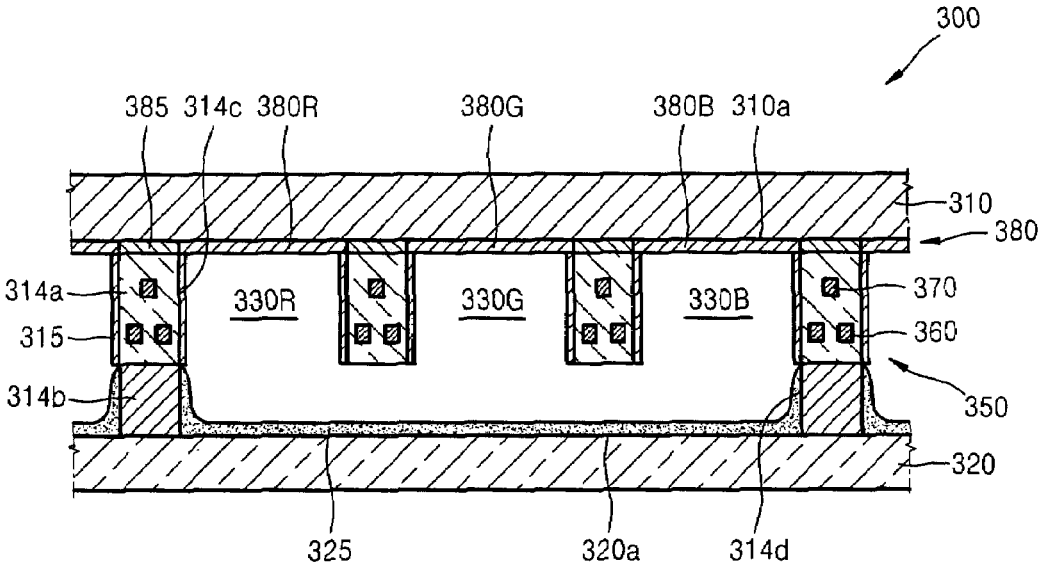
FIG. 4 illustrates a partial cross-sectional view of a plasma display panel according to a second exemplary embodiment of the present invention.

FIG. 4 illustrates a partial cross-sectional view of a plasma display panel 300 according to a second exemplary embodiment of the present invention. Referring to FIG. 4, the plasma display panel 300 may include a first substrate 310 and a second substrate 320 facing each other.

The plasma display panel 300 may further include an electrode sheet 350 disposed between the first substrate 310 and the second substrate 320. The electrode sheet 350 may include first barrier ribs 314*a* defining a plurality of red, green and blue discharge cells 330R, 330G and 330B. The first barrier ribs 314*a* may be formed of, e.g., dielectric substances. The electrode sheet 350 may further include a plurality of pairs of discharge electrodes disposed in the first barrier ribs 314*a* for generating discharge in the red, green and blue discharge cells 330R, 330G and 330B. Referring to FIG. 4, the first barrier ribs 314*a* may only partially extend along a distance between the first substrate 310 and the second substrate 320.

Each pair of discharge electrodes may include a first discharge electrode 360 and a second discharge electrode 370. The first discharge electrodes 360 and the second discharge electrodes 370, which may be formed in the first barrier ribs 314*a*, may be spaced apart from each other along the Z direction, i.e., vertically to the first substrate 310. The first discharge electrodes 360 and the second discharge electrodes 370 may include one or more of the features described above with regard to the first discharge electrodes 260 and the second discharge electrodes 270 of the first exemplary embodiment of the plasma display panel 200 illustrated in FIGS. 1-3. For example, each of the first discharge electrodes 360 may extend along a first direction, e.g. X direction, and may surround, along an XY plane, each of the red discharge cells 330R, the green discharge cells 330G and/or the blue discharge cells 330B disposed along the X direction. Each of the second discharge electrodes 370 may extend along a second direction, e.g., Y direction, and may surround, along an XY plane, each of the red discharge cells 330R, the green discharge cells 330G and/or the blue discharge cells 330B disposed along the Y direction. As set forth above, the X direction may cross, e.g., be perpendicular to, the Y direction, and both the X and Y directions may cross the Z direction. Accordingly, the first discharge electrodes 360 may overlap the second discharge electrodes 370. In embodiments of the invention, the electrode sheet 350 may include protective layers 315 formed on inner sidewalls of the first barrier ribs 314*a*.

The plasma display panel 300 may further include second barrier ribs 314*b* disposed between the electrode sheet 350 and the second substrate 320. In embodiments of the invention, the second barrier ribs 314*b* may be arranged to overlap some or all of the first barrier ribs 314*a*. As illustrated in FIG. 4, the second barrier ribs 314*b* may further partition the space between the first and second substrates 310, 320 by surrounding, along an XY plane, spaces corresponding to, e.g., unit pixels having the red, green and blue discharge cells 330R, 330G and 330B, but the present invention is not limited thereto. For example, the second barrier ribs 314*b* may define substantially oval-like or rectangular-like spaces corresponding to multiple ones of the discharge cells, e.g., one discharge cell for each primary color, and may only overlap portions of corresponding ones of the corresponding first barrier ribs 214*a*. In embodiments in which the second barrier ribs 314*b* correspond to multiple ones of the discharge cells 330B, 330G, 330R, a general cross sectional shape of the second barrier ribs 314*b* corresponding to, e.g., a unit cell, may be substantially the same as a general cross-sectional shape of the first barrier ribs 314*a* corresponding to one of the discharge cells 330B, 330G, 330R. That is, in such embodiments, only a general size of the resulting cross-sectional shape along, e.g., an XY plane substantially parallel to the first substrate 310 and/or the second substrate 320, may be different. In other embodiments of the invention, the second barrier ribs 314*b* have a different cross-sectional shape and/or a different size relative to corresponding portions of the first barrier ribs 314*a*, e.g., may be formed to be, thinner or thicker along the X and/or Y directions, and/or shorter or taller along the Z direction, relative to the first barrier ribs 314*a*.

More particularly, e.g., the second barrier ribs 314*b* may completely extend along a distance between the respective portions of the first barrier ribs 214*a* and the second substrate 320 such that a combination of the first barrier ribs 214*a*, the second barrier ribs 214*b*, the first substrate 210 and the second substrate 220 surround one discharge cell corresponding to each primary color, e.g., red, green and blue discharge cells 330R, 330G, 330B. In some embodiments of the invention, overlapping portions of the respective sidewall portions 314*c*, 314*d* of the first and second barrier ribs 314*a*, 314*b* may substantially or completely line up, while in other embodiments of the invention, overlapping portions of the respective sidewall portions 314*c*, 314*d* may not line up, thereby forming, e.g., a stepped boundary (not shown).

The second barrier ribs 314*b* may be formed using a sand blasting process after applying a barrier layer paste on the second substrate 320.

Referring to FIG. 4, phosphor layers 325 may be disposed on the inner sidewalls 314*d* of the second barrier ribs 314*b* and/or an upper surface 320*a* of the second substrate 320. Accordingly, as a result of the second barrier ribs 314*b*, in some embodiments of the invention, the phosphor layers 325 may be formed on more surfaces and/or larger surface portions of the respective discharge cells 230G, 230R, 230B. Thus, embodiments of the invention may provide plasma display panels having increased light emitting efficiency.

The phosphor layers 325 may be white light-emitting phosphor layers generating white light using ultraviolet light. In cases in which the phosphor layers 325 are formed of red, green and blue light-emitting phosphor layers, the second barrier ribs 314*b* may be assembled to be completely aligned with the first barrier ribs 314*a*. However, in embodiments of the invention in which the phosphor layers 325 are white light-emitting phosphor layers, alignment of the second barrier ribs 314*b* and the first barrier ribs 214*a* is not required. Also, as discussed above, the shape of the first barrier ribs 314*a* and the shape of the second barrier ribs 314*b* may be different from each other. Hence, a process of manufacturing the plasma display panel 300 according to one or more aspects of the invention may be simplified relative to conventional processes of manufacturing a plasma display device.

A color filter layer 380 may be formed between the first barrier ribs 314*a* and the first substrate 310. More particularly, the color filter layer 380 may be formed on a lower surface 310*a* of the first substrate 310. The color filter layer 380 my include red, green and blue color filter layers 380R, 380G and 380B and light absorbing layers 385. The red, green and blue color filter layers 380R, 380G and 380B may each be formed to correspond to the red, green and blue discharge cells 330R, 330G and 330B, respectively. The light absorbing layers 385 may be substantially opaque, e.g., black in color, and may absorb external light. The light absorbing layers 385 may be formed corresponding to non-discharge areas, e.g., on portions of the first substrate 310 overlapping the barrier first barrier ribs 314*a* along the Z direction. Thus, in embodiments of the invention, the light absorbing layers 385 may face the first barrier ribs 314*a*. Accordingly, bright room contrast of the plasma display panel 300 may be improved due to reduced external light refection as a result of the light absorbing layers 385.

The plasma display panel 300 may further include discharge gas disposed in the red, green and blue discharge cells 330R, 330G, and 330B. The method of operating the plasma display panel 300 is similar to that of the plasma display panel 200 of FIG. 1, and thus, a detailed description thereof is omitted.

Figure 5:
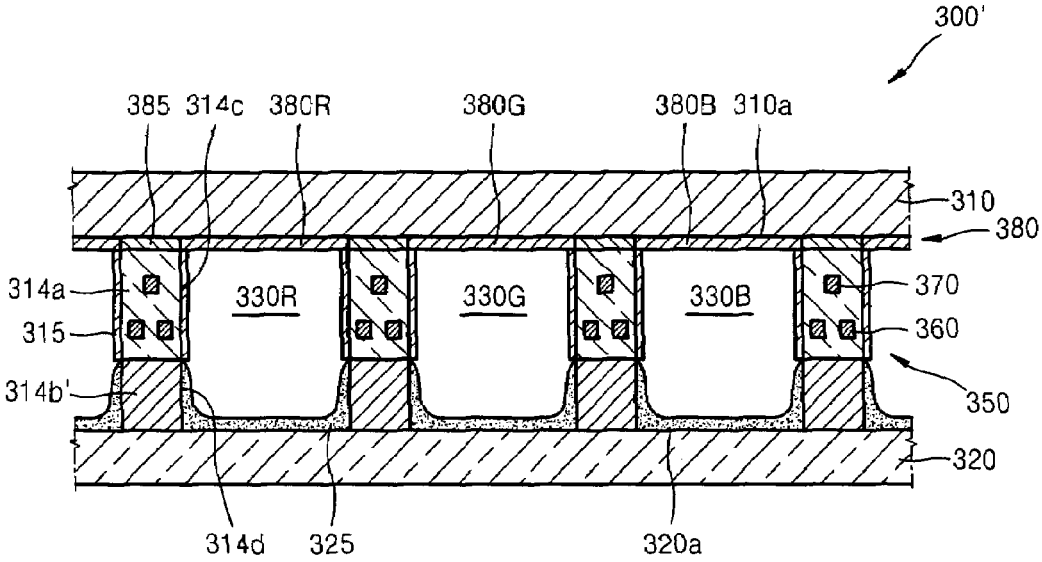
FIG. 5 illustrates a partial cross-sectional view of a plasma display panel according to a third exemplary embodiment of the present invention.

FIG. 5 illustrates a partial cross-sectional view of a plasma display panel 300' according to a third exemplary embodiment of the present invention. The plasma display panel 300' substantially corresponds to the plasma display panel 300 illustrated in FIG. 4. The same reference numerals as FIG. 4 denote the same elements. In FIG. 5, a plurality of second barrier ribs 314*b'* may be formed corresponding to each of a plurality of first barrier ribs 314*a*. Accordingly, the first barrier ribs 314*a* and the second barrier ribs 314*b'* support each other stably to stabilize the structure of the plasma display panel 300. Also, the area of phosphor layers 325, e.g., white light-emitting phosphor layers, increases, which may thereby increase a light-emitting efficiency of the plasma display panel 300'.

Figure 6:
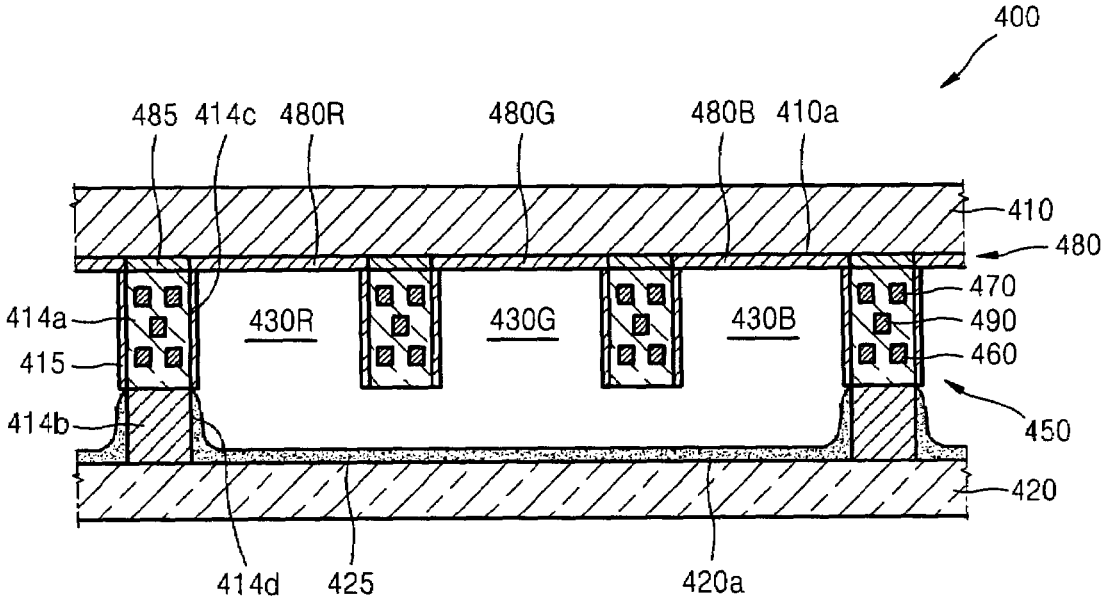
FIG. 6 illustrates a partial cross-sectional view of a plasma display panel according to a fifth exemplary embodiment of the present invention.
Figure 7:
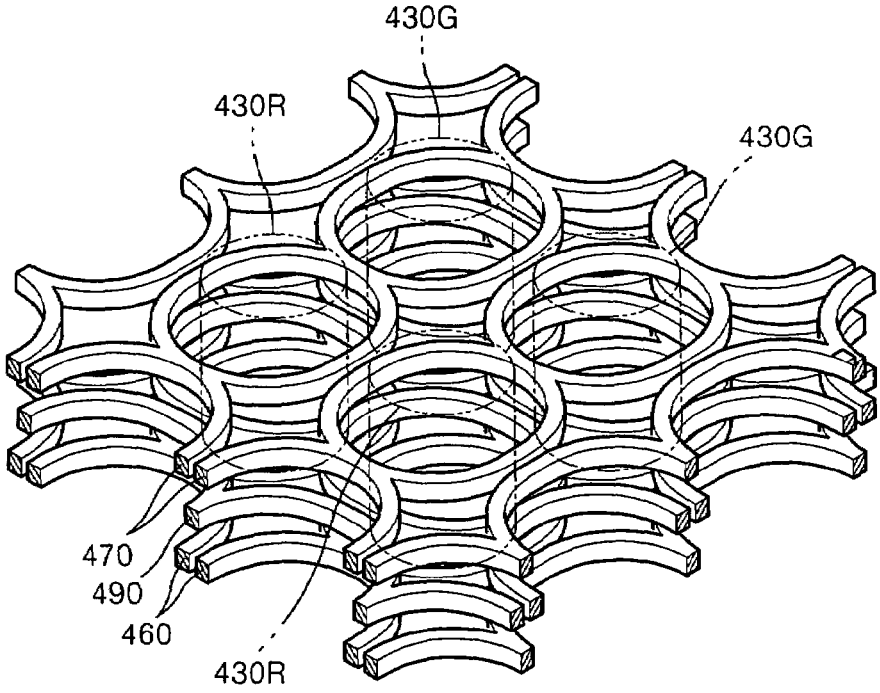
FIG. 7 illustrates a schematic layout diagram of discharge cells, first and second discharge electrodes and address electrodes of the exemplary plasma display panel illustrated in FIG. 6.

FIG. 6 illustrates a partial cross-sectional view of a plasma display panel 400 according to a fifth exemplary embodiment of the present invention. FIG. 7 illustrates a schematic layout diagram of discharge cells 430R, 430G and 430B, first and second discharge electrodes 460 and 470 and address electrodes 490 of the exemplary embodiment illustrated in FIG. 6.

In FIG. 6, the plasma display panel 400 may include a first substrate 410 and a second substrate 420 facing each other.

The plasma display panel 400 may include an electrode sheet 450 disposed between the first substrate 410 and the second substrate 420. The electrode sheet 450 may include first barrier ribs 414*a* defining a plurality of red, green and blue discharge cells 430R, 430G and 430B. The first barrier ribs 414*a* may be formed of dielectric substances. The electrode sheet 450 may include a plurality of pairs of discharge electrodes disposed in the first barrier ribs 414*a* for generating discharge in the red, green and blue discharge cells 430R, 430G and 430B. Each pair of discharge electrodes may include the first discharge electrode 460 and the second discharge electrode 470. The first discharge electrodes 460 and the second discharge electrodes 470, which may be formed in the first barrier ribs 414*a*, may be spaced apart from each other along the Z direction, i.e., perpendicular to the first substrate 410. Referring to FIG. 7, each of the first discharge electrodes 460 and the second discharge electrodes 470 may extend parallel to each other along the Y direction, and may respectively surround, along an XY plane, the red discharge cells 430R, green discharge cells 430G and/or the blue discharge cells 430B disposed along the Y direction. The first discharge electrodes 460 and the second discharge electrodes 470 may be spaced apart from each other along the Z direction.

The electrode sheet 450 may include the address electrodes 490 extending so as to overlap the first discharge electrodes 460 and the second discharge electrodes 470. For example, the address electrodes 490 may extend along the X direction. The address electrodes 490, which may be formed in the first barrier ribs 414*a*, may be spaced apart from the first and second discharge electrodes 460, 470 along the Z direction. Referring to FIG. 7, the address electrodes 490 may extend along the X direction and may surround, along an XY plane, each of the discharge cells 430R, 430G and 430B disposed along the X direction. Adjacent ones of the address electrodes 490 may be spaced apart from each other along the Y direction.

As shown in FIG. 6, the second discharge electrodes 470, the address electrodes 490 and the first discharge electrodes 460 may be sequentially arranged apart from each other, and such that the second discharge electrodes 470 are closest to the first substrate 410 with the address electrodes in between the first and second discharge electrodes 460, 470, to help reduce an address discharge voltage. However, the present invention is not limited thereto, and the address electrodes 490 may be disposed closest to the first substrate 410 or farthest from the first substrate 410. In some embodiments of the invention, the address electrodes 490 may be formed on the second substrate 420. The address electrodes 490 may generate address discharge for easy sustain discharge between the first discharge electrode 460 and the second discharge electrode 470. More particularly, the address electrodes 490 may reduce a voltage for initiating a sustain discharge. Referring to FIG. 6, the first discharge electrodes 460 may serve as scan and sustain electrodes and the second discharge electrodes 470 serve as sustain electrodes, but the present invention is not limited thereto.

The electrode sheet 450 may include protective layers 415 formed on inner sidewalls 414*c* of the first barrier ribs 414*a*, which may protect the first barrier ribs 414*a* and may generate secondary electrons.

The plasma display panel 400 may further include second barrier ribs 414*b* disposed between the electrode sheet 450 and the second substrate 420. The second barrier ribs 414*b* may have one, some or all of the features of the second barrier ribs 314*b* of the exemplary embodiment illustrated in FIG. 5, e.g., the shape of the second barrier ribs 414*b* is not limited, and may be similar to the shape of the second barrier ribs 314*b*.

In the plasma display panel 400, phosphor layers 425 may be disposed on inner sidewalls 414*d* of the second barrier ribs 414*b* and on an upper surface 420*a* of the second substrate 420. The phosphor layers 425 may be white light-emitting phosphor layers that may generate white light using ultraviolet light. Areas where the phosphor layers 425 may be formed may be increased as a result of the second barrier ribs 414*b*, which may thereby, increase a light emitting efficiency of the plasma display panel 400. Because the phosphor layers 425 are white light-emitting phosphor layers, alignment of the second barrier ribs 414*b* and the first barrier ribs 414*a* is not required. Also, the shape of the first barrier ribs 414*a* and the shape of the second barrier ribs 414*b* can be different from each other. Hence, embodiments of the invention enable the manufacturing process of a plasma display panel to be simplified. Referring to FIG. 6, the second barrier ribs 414*b* may define spaces between the electrode sheet 450 and the second substrate 420, corresponding to unit pixels including each of primary colors, e.g., the red, green and blue discharge cells 430R, 430G and 430B, but the present invention is not limited thereto.

A color filter layer 480 may be formed between the first barrier ribs 414*a* and the first substrate 410. More particularly, the color filter layer 480 may be formed on a bottom surface 410*a* of the first substrate 410. The color filter layers 480 may include red, green and blue color filter layers 480R, 480G and 480B and light absorbing layers 485. The red, green and blue color filter layers 480R, 480G and 480B may each be formed to correspond to the red, green and blue discharge cells 430R, 430G and 430B, respectively. The light absorbing layers 485 may be opaque, e.g., substantially black in color, and may absorb external light. Hence, the light absorbing layers 485 may be formed corresponding to non-discharge areas, and more particularly, e.g., may be formed facing the first barrier ribs 414*a*. Accordingly, due to reduced external light reflection as a result of the light absorbing layers 485, the bright room contrast of the plasma display panel 400 may be improved.

The plasma display panel 400 may further include discharge gas disposed in the red, green and blue discharge cells 430R, 430G and 430B.

A method of operating the plasma display panel 400 will now be described. An address discharge may be generated between the first discharge electrodes 460 and the address discharge electrodes 490, resulting in the selection of the red, green and blue discharge cells 430R, 430G and 430B that generate a sustain discharge. Thereafter, when a sustain voltage is applied between the first discharge electrodes 460 and the second discharge electrodes 470 of the selected red, green and blue discharge cells 430R, 430G and 430B, the sustain discharge is generated between the first and second discharge electrodes 460 and 470. An energy level of the discharge gas excited by the sustain discharge is reduced, thereby discharging ultraviolet light. The ultraviolet light excites the phosphor layers 425, such that an energy level of the excited phosphor layers 425 may be reduced to generate white light. The white light may be transmitted through the red, green and blue color filter layers 480R, 480G and 480B to become red, green and blue light, respectively. The red, green and/or blue light may form an image independently or using a mixture thereof.

Figure 8:
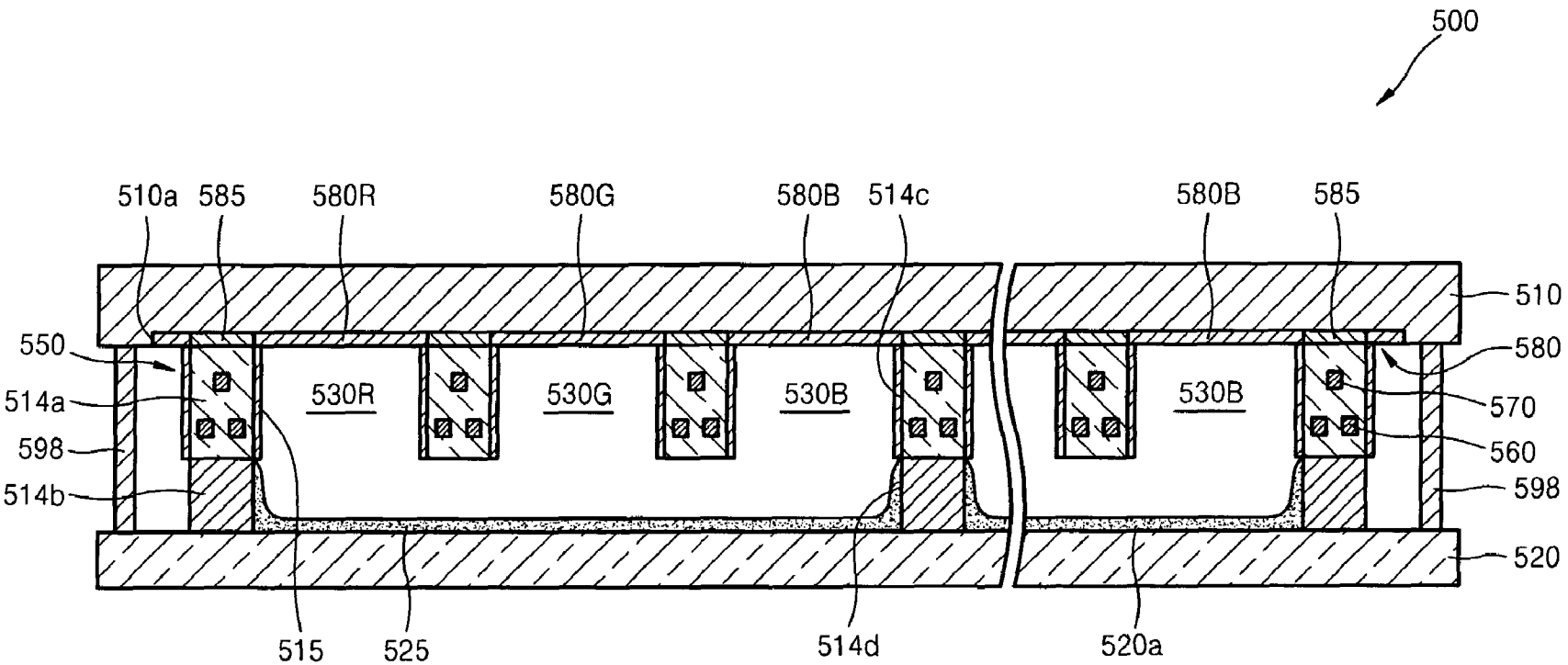
FIG. 8 illustrates a cross-sectional view of a plasma display panel according to a sixth exemplary embodiment of the present invention.

FIG. 8 illustrates a cross-sectional view of a plasma display panel 500 according to a sixth exemplary embodiment of the present invention. Referring to FIG. 8, the plasma display panel 500 may include a first substrate 510 and a second substrate 520 facing each other.

The plasma display panel 500 may include an electrode sheet 550 disposed between the first substrate 510 and the second substrate 520. The electrode sheet 550 may include first barrier ribs 514*a* defining a plurality of red, green and blue discharge cells 530R, 530G and/or 530B. The first barrier ribs 514*a* may be formed of dielectric substances. The electrode sheet 550 may include a plurality of pairs of discharge electrodes disposed in the first barrier ribs 514*a* for generating discharge in the red, green and blue discharge cells 530R, 530G and/or 530B. Each pair of discharge electrodes may include a first discharge electrode 560 and a second discharge electrode 570. The first discharge electrodes 560 and the second discharge electrodes 570 may be spaced apart from each other along the Z direction in the first barrier ribs 514*a*. Each of the first discharge electrodes 560 may extend along the X direction and may surround, along an XY plane, each of the red discharge cells 530R, the green discharge cells 530G and/or the blue discharge cells 530B disposed in, e.g., a row along the X direction. Also, each second discharge electrode 570 may extend along the Y direction and may surround, along an XY plane, each of the red discharge cells 530R, the green discharge cells 530G and the blue discharge cells 530B disposed in a row along the Y direction. Accordingly, the first discharge electrodes 560 may overlap the second discharge electrodes 570. The electrode sheet 550 may include protective layers 515 formed on inner sidewalls 514*c* of the first barrier ribs 514*a*.

The plasma display panel 500 further includes second barrier ribs 514*b* disposed between the electrode sheet 550 and the second substrate 520. The shape of the second barrier ribs 514*b* is not limited, and may be similar to the shape of the second barrier ribs 314*b* of FIG. 5.

In the plasma display panel 500, phosphor layers 525 may be disposed on inner sidewalls 514*d* of the second barrier ribs 514*b* and on an upper surface of the second substrate 520. The phosphor layers 525 are white light-emitting phosphor layers generating white light using ultraviolet light. The areas wherein the phosphor layers 525 may be formed are increased due to the second barrier ribs 514*b*, which may thereby, increase a light emitting efficiency of the plasma display panel 500. Because the phosphor layers 525 are white light-emitting phosphor layers, alignment of the second barrier ribs 514*b* and the first barrier ribs 514*a* is not required, and the shape of the first barrier ribs 514*a* and the shape of the second barrier ribs 514*b* can be different from each other. Hence, embodiments of the invention provide a simplified manufacturing process for manufacturing a plasma display panel. In the exemplary embodiment illustrated in FIG. 8, the second barrier ribs 514*b* further define spaces the first substrate 510 and the second substrate 520, and more particularly, between the electrode sheet 550 and the second substrate 520 corresponding to unit pixels having each of the primary colors, e.g., red, green and blue discharge cells 530R, 530G and 530B, but the present invention is not limited thereto.

A color filter layer 580 may be formed between the first barrier ribs 514*a* and the first substrate 510. More particularly, in embodiments of the invention, a groove 510*a* may be formed in the first substrate 510 and the color filter layer 580 may be formed in the groove 510*a*. Because the thickness of the first substrate 510 may be reduced due to the groove 510*a*, the transmission rate of visible light may be increased.

The color filter layer 580 may include red, green and blue color filter layers 580R, 580G and 580B and light absorbing layers 585. The red, green and blue color filter layers 580R, 580G and 580B may each be formed to correspond to the red, green and blue discharge cells 530R, 530G and 530B, respectively. The light absorbing layers 585 may be opaque, e.g., substantially black in color, and may absorb external light. Hence, the light absorbing layers 585 are formed corresponding to non-discharge areas, and in detail, are formed facing the first barrier ribs 514*a*. Accordingly, bright room contrast of the plasma display panel 500 may be improved due to reduced external light refection as a result of the light absorbing layers 585. In FIG. 8, a single groove 510*a* is formed in all areas of the first substrate 510. However, grooves 510*a* may be formed only in portions of the first substrate 510 corresponding to the red, green and blue color filter layers 580R, 580G and 580B.

The plasma display panel 500 may include a discharge gas disposed in the discharge cells 530R, 530G and 530B. The first substrate 510 and the second substrate 520 may be connected to each other using a sealing layer 598 formed between edges of the first substrate 510 and the second substrate 520.

The method of operating the plasma display panel 500 is similar to that of the plasma display panel 200 of FIG. 1. Thus, a detailed description thereof is omitted.

In the plasma display panels according to the present invention, the process of forming phosphor layers is simplified, thereby reducing manufacturing time.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel comprising:

a first substrate and a second substrate facing each other;

barrier ribs disposed between the first substrate and the second substrate, and at least partially defining a plurality of discharge cells therebetween, the barrier ribs including first barrier rib portions and second barrier rib portions extending between the first and second substrates;

a plurality of pairs of discharge electrodes for generating a discharge in the discharge cells, the plurality of pairs of discharge electrodes being arranged in non-display portions of the plasma display panel; and a color filter layer disposed between the barrier ribs and the first substrate, wherein the first barrier rib portions are adjacent the first substrate and partially extend between the first and second substrates, the second barrier rib portions are between the first barrier rib portions and the second substrate, and a number of first barrier rib portions is greater than a number of second barrier rib portions.

2. The plasma display panel as claimed in claim 1, wherein the color filter layer comprises a pattern of red color filter layers, green color filter layers and blue color filter layers formed corresponding to the discharge cells.

3. The plasma display panel as claimed in claim 2, wherein the color filter layer further comprises light absorbing layers formed corresponding to the barrier ribs.

4. The plasma display panel as claimed in claim 3, wherein the light absorbing layers are substantially opaque.

5. The plasma display panel as claimed in claim 1, wherein each of the red color filter layers, green color filter layers and blue color filter layers is separated by a light absorbing layer, and corresponds to a single one of the plurality of discharge cells.

6. The plasma display panel as claimed in claim 1, wherein:

each of the pairs discharge electrodes includes a first discharge electrode and a second discharge electrode substantially spaced apart from each other along a direction perpendicular to a direction along which the first substrate extends, the first discharge electrode and the second discharge electrode extend in directions crossing each other, and the first discharge electrode and the second discharge electrode surround at least some portions of each discharge cell disposed along the respective directions in which each of the first discharge electrode and the second discharge electrode extend.

7. The plasma display panel as claimed in claim 1, wherein:

each of the pairs of discharge electrodes includes a first discharge electrode and a second discharge electrode arranged within the barrier ribs and substantially spaced apart from each other in a vertical direction to the first substrate, the first discharge electrode and the second discharge electrode extend parallel to each other, and the first discharge electrode and the second discharge electrode surround at least some portions of each discharge cell disposed along the respective directions in which each of the first discharge electrode and the second discharge electrode extend.

8. The plasma display panel as claimed in claim 7, further comprising address electrodes substantially at least partially disposed in the barrier ribs and spaced apart from the plurality of pairs of discharge electrodes along a direction perpendicular to a direction along which the first substrate extends, the address electrodes substantially extending in a direction crossing the plurality of pairs of discharge electrodes, wherein the address electrodes surround at least some portions of each discharge cell disposed in the respective directions along which each of the address electrodes extend.

9. The plasma display panel as claimed in claim 1, wherein the plasma display panel further comprises phosphor layers formed in the discharge cells.

10. The plasma display panel as claimed in claim 9, wherein the phosphor layers include a white light emitting phosphor substance.

11. The plasma display panel as claimed in claim 9, wherein:

the plurality of pairs of discharge electrodes at least partially extend within the first barrier rib portions, and the second barrier rib portions at least partially overlap the first barrier rib portions such that respective overlapping first and second barrier rib portions extend between the first substrate and the second substrate, and at least some portions of the phosphor layers are formed on the second barrier rib portions.

12. The plasma display panel as claimed in claim 1, wherein the first barrier rib portions and the second barrier rib portions have at least one of a different cross-sectional shape along a plane substantially parallel to the first substrate and a different size.

13. The plasma display panel as claimed in claim 1, wherein the barrier ribs have a cross-sectional shape along a plane substantially parallel to the first substrate such that the barrier ribs define a plurality of cylindrical shaped portions between the first substrate and the second substrate.

14. The plasma display panel as claimed in claim 13, wherein each of the plurality of pairs of discharge electrodes include a plurality of circular shaped portions at least partially surrounding respective ones of the plurality of cylindrical shaped portions defined by the barrier ribs.

15. The plasma display panel as claimed in claim 14, wherein each of the plurality of circular shaped portions corresponding to each of the discharge electrodes are electrically connected.

16. The plasma display panel as claimed in claim 1, wherein the discharge cells have a polygonal cross sectional shape along a plane substantially parallel to the first substrate.

17. The plasma display panel as claimed in claim 1, wherein the first barrier rib portions and the second barrier rib portions have at least one of a same cross-sectional shape along a plane substantially parallel to the first substrate and a same size.

18. The plasma display panel as claimed in claim 1, wherein the barrier ribs include a plurality of dielectric layers stacked on each other.

19. The plasma display panel as claimed in claim 1, wherein each of the plurality of discharge cells includes a white light emitting phosphor substance.

20. The plasma display panel as claimed in claim 1, wherein the color filter layer is disposed in a groove formed on a surface of the first substrate that faces the second substrate.

21. The plasma display panel as claimed in claim 1, wherein:

at least two discharge cells define a unit pixel;

the first barrier rib portions define the sat least two discharge cells; and the first and second barrier rib portions define unit pixels.

* * * * *